US007438097B2

(12) United States Patent
Davis

(10) Patent No.: US 7,438,097 B2
(45) Date of Patent: Oct. 21, 2008

(54) REDUCING MACHINE ROTOR ASSEMBLY AND INSERTS THEREFOR AND METHOD OF CONSTRUCTING THE INSERTS

(75) Inventor: Devin R. Davis, Shepherd, MI (US)

(73) Assignee: Morbark, Inc., Winn, MI (US)

( * ) Notice: Subject to any disclaimer, the term of this patent is extended or adjusted under 35 U.S.C. 154(b) by 0 days.

(21) Appl. No.: 11/363,693

(22) Filed: Feb. 28, 2006

(65) Prior Publication Data

US 2006/0196982 A1 Sep. 7, 2006

(51) Int. Cl.
*B27C 1/00* (2006.01)

(52) U.S. Cl. ..... 144/174; 241/197; 241/292.1; 241/293

(58) Field of Classification Search ..... 144/162.1, 144/172, 174, 218, 220; 241/194, 195, 197, 241/300, 300.1, 292.2, 293
See application file for complete search history.

(56) References Cited

U.S. PATENT DOCUMENTS

| | | | |
|---|---|---|---|
| 286,630 | A | 10/1883 | Orton |
| 389,139 | A | 9/1888 | Dumontier |
| 486,901 | A | 11/1892 | Shimer |
| 824,589 | A | 6/1906 | Ruth et al. |
| 2,865,572 | A | 12/1958 | Lannert |
| 2,986,347 | A | 5/1961 | Stevenson |
| 3,547,360 | A | 12/1970 | Sherman, Jr. |
| 3,642,212 | A | 2/1972 | Volt |
| 3,642,214 | A | 2/1972 | Blackwell, Jr. |
| 3,818,561 | A | 6/1974 | Montana et al. |
| 3,876,158 | A | 4/1975 | Rogers |
| 4,205,799 | A | 6/1980 | Brewer |
| 4,628,976 | A | 12/1986 | Loring |
| 4,892,260 | A | 1/1990 | Hager |
| 4,915,309 | A | 4/1990 | Schmidt |
| 5,070,920 | A | 12/1991 | Morey |
| 5,148,844 | A | 9/1992 | Robison |

(Continued)

FOREIGN PATENT DOCUMENTS

| | | |
|---|---|---|
| DE | 88 00 928.9 | 1/1988 |

OTHER PUBLICATIONS

Product catalog paper entitled: "Duratech Model 2009 Industrial Tub Grinder".

(Continued)

*Primary Examiner*—Shelley Self
(74) *Attorney, Agent, or Firm*—Reising, Ethington, Barnes Kisselle, P.C.

(57) ABSTRACT

A comminuting machine rotor assembly comprising rotors carried by a shaft for conjoint rotation with the shaft, hammer heads carried by the rotors and extending radially outwardly from the shaft, and hammer inserts releasably attached to respective ones of the hammer heads. There is a wear material coating over at least a first cutting edge of an insert body of each insert. The first cutting edge of each insert body is defined by a front facet generally facing the direction of assembly rotation, a radially outer end facet adjacent the front facet, and an intervening radially distal corner of the hammer insert formed at the intersection of the front and end facets. The front and end facets are disposed at a relative angle of greater than 60 degrees to one another.

8 Claims, 4 Drawing Sheets

U.S. PATENT DOCUMENTS

| | | | | |
|---|---|---|---|---|
| 5,271,440 | A | | 12/1993 | Bradstreet, Jr. et al. |
| 5,307,719 | A | | 5/1994 | MacLennan |
| 5,372,316 | A | | 12/1994 | Bateman |
| 5,379,951 | A | | 1/1995 | Hughes |
| 5,409,047 | A | | 4/1995 | Jorgensen |
| 5,419,502 | A | | 5/1995 | Morey |
| D360,421 | S | | 7/1995 | Schulz et al. |
| 5,497,950 | A | | 3/1996 | Schrodl |
| 5,547,136 | A | | 8/1996 | Steffens et al. |
| 5,713,525 | A | | 2/1998 | Morey |
| 5,803,380 | A | | 9/1998 | Brand et al. |
| 5,911,372 | A | | 6/1999 | Williams, Jr. |
| 5,950,942 | A | | 9/1999 | Brand et al. |
| 5,967,436 | A | * | 10/1999 | Balvanz ..... 241/291 |
| 6,045,072 | A | | 4/2000 | Zehr |
| 6,059,210 | A | | 5/2000 | Smith |
| 6,079,649 | A | | 6/2000 | Balvanz et al. |
| 6,131,838 | A | | 10/2000 | Balvanz et al. |
| 6,142,400 | A | | 11/2000 | Balvanz et al. |
| 6,154,948 | A | | 12/2000 | Williams, Jr. |
| 6,227,469 | B1 | | 5/2001 | Daniels, Jr. et al. |
| 6,308,905 | B1 | | 10/2001 | Balvanz et al. |
| 6,311,910 | B1 | | 11/2001 | Balvanz et al. |
| 6,394,375 | B1 | | 5/2002 | Balvanz et al. |
| 6,419,173 | B2 | | 7/2002 | Balvanz et al. |
| 6,422,495 | B1 | | 7/2002 | De Boef et al. |
| 6,435,434 | B1 | | 8/2002 | Monyak |
| 6,464,157 | B1 | | 10/2002 | Balvanz et al. |
| 6,481,654 | B1 | | 11/2002 | Balvanz et al. |
| 6,494,394 | B1 | | 12/2002 | Balvanz et al. |
| 6,520,440 | B2 | | 2/2003 | Ragnarsson |
| 6,622,951 | B1 | * | 9/2003 | Recker et al. ..... 241/195 |
| 6,840,471 | B2 | | 1/2005 | Roozeboom et al. |
| 6,880,774 | B2 | * | 4/2005 | Bardos et al. ..... 241/189.1 |
| 2006/0179634 | A1 | | 8/2006 | Bardos |

OTHER PUBLICATIONS

Product catalog paper entitled: "DuraTech Model 2009" featuring 5 photos.
Product catalog paper entitled: "In A Class All By Itself".
Product catalog paper entitled: "www.DURATECHINDUSTRIES.net" Model 2009 Specifications.
Six pages from catalog entitled "Vermeer Tub Grinder TG 7000".
Two pages from product catalog entitled "Morbank Tub Grinder Product Information".
Two pages from product catalog entitled "Model 6700B".
Six pages from product catalog entitled "Hogzilla TC Series Tub Grinders".

* cited by examiner

REDUCING MACHINE ROTOR ASSEMBLY AND INSERTS THEREFOR AND METHOD OF CONSTRUCTING THE INSERTS

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to wood comminuting machines, such as tub grinders, horizontal feed grinders, gravity-fed grinders, or the like, and more particularly to rotor assemblies including inserts for reducing wood product into cuts or chips.

2. Description of the Related Art Including Information Disclosed Under 37 CFR 1.97 and 1.98

Wood grinding or chipping machines typically have hammers mounted on rotors. Replaceable hammer inserts with cutters are supported on the rotors for cutting or fragmenting wood product. The rotors rotate about a common longitudinal axis to bring the hammer inserts into cooperation with at least one anvil spaced radially outward from the inserts. As each hammer insert passes the anvil, the wood product is cut between the insert and the anvil. The hammer inserts are commonly coated with a welded-on hard, abrasive wear material, such as tungsten carbide, to facilitate cutting the wood product and to provide the inserts with a longer useful life. Ultimately, the wear material abrades during use, particularly at cutting edges of the inserts that pass nearest the anvil. As a result, the inserts must be replaced on a regular basis to maintain their ability to provide an efficient reduction of the wood product. This increases the cost of the wood product reduction process.

To increase their useful lives hammer inserts are known to include pairs of cutting edges disposed at opposite ends of each insert. When one cutting edge of an insert located in an active cutting position is worn out, the insert can be detached, rotated, and reattached to position the remaining cutting edge in the active cutting position.

To increase their effectiveness in cutting and fragmenting wood, hammer inserts are known to include cutting edges defined by pairs of facets that converge to form a diagonally outwardly directed radially distal corners positioned to pass very close to an anvil when in the active cutting position. However, the facets form acute angles of less than 60 degrees leaving very little material thickness to support the welded-on abrasive wear material coating.

BRIEF SUMMARY OF THE INVENTION

According to the invention, a rotor assembly is provided for use in a comminuting machine for wood and the like. The rotor assembly includes a shaft arranged for driven rotation about an axis, a plurality of rotors carried by the shaft in generally adjacent relation to one another for conjoint rotation with the shaft. A plurality of hammer heads are carried by the rotors and extend radially outwardly from the shaft. A plurality of hammer inserts are releasably attached to respective ones of the hammer heads. Each insert includes an insert body and a wear material coating over at least a first cutting edge portion of its insert body. The first cutting edge of each insert body is defined by a front facet generally facing the direction of assembly rotation, a radially outer end facet adjacent the front facet, and an intervening radially distal corner of the hammer insert formed at the intersection of the front and end facets. The front and end facets are disposed at a relative angle of greater than 60 degrees to one another which provides a greater amount of material between facets to withstand the metallic intrusion caused by the process of welding-on abrasive wear material coating and to provide a more robust structure to withstand forces encountered in an operating wood comminuting machine.

According to another aspect of the inventive rotor assembly, the angle between the front facet and the adjacent end facet of each insert cutting edge is greater than or generally equal to 90 degrees to provide an even more robust structure to withstand comminuting forces.

According to another aspect of the inventive rotor assembly, the front and end facets of each insert cutting edge are flat.

According to another aspect of the inventive rotor assembly, the front facet of each insert cutting edge is generally parallel to an imaginary radius line passing from the rotational axis through the hammer carrying the insert.

According to another aspect of the inventive rotor assembly, each hammer insert includes a second cutting edge disposed opposite its first cutting edge, each insert being reversably attachable to a hammer to interchangeably dispose the two cutting edges in either a radially-outward active cutting position or a radially-inward idle non-cutting position.

According to another aspect of the inventive rotor assembly, the second cutting edge of each insert body is defined by a front facet generally facing the direction of assembly rotation, an end facet adjacent the front facet and opposite the end facet of the first cutting edge, and an intervening corner formed at the intersection of the front facet and the end facet. The front facets of the opposite cutting edges of each insert are generally coplanar.

According to another aspect of the invention a hammer insert is provided for releasable attachment to a rotor in a comminuting machine. The hammer insert comprises a first cutting edge including a front facet, an end facet adjacent the front facet, and an intervening corner formed at the intersection of the front and end facets. The front and end facets are disposed at a relative angle of less than 60 degrees to one another. The hammer insert also includes a wear material coating disposed on the first cutting edge, and a mount configured to removably attach the hammer insert to a rotor in a comminuting machine. The front facet is disposed in a position on the insert that will face the front facet in the general direction of rotor rotation when the insert is attached to a rotor in a comminuting machine.

According to another aspect of the inventive hammer insert, the corner of the first cutting edge of the hammer insert is disposed in a position that will place the corner at a radially distal end of the insert when the hammer insert is attached to a rotor in a comminuting machine.

According to another aspect of the inventive hammer insert, a second cutting edge is disposed opposite the first cutting edge. The second cutting edge comprises a second front facet disposed in a position on the insert that will face the second front facet in the general direction of rotor rotation when the insert is attached to a rotor in a comminuting machine. A second end facet is disposed adjacent the second front facet and opposite the end facet of the first cutting edge.

According to another aspect of the inventive hammer insert, the front facets of the opposite cutting edges are generally coplanar.

According to another aspect of the inventive hammer insert, the front facets of the cutting edges are disposed on a front surface of the hammer insert and inclined surfaces extend from the end facets to a back surface of the insert disposed opposite the front surface. The inclined surfaces partly converge toward one another from the end facets.

According to another aspect of the inventive hammer insert, the front surface of the hammer insert includes a pair of relief faces extending inward from the front facets at an inclination to define reflex angles between the front facets and the relief faces.

According to another aspect of the invention a method is provided for constructing a hammer insert for a comminuting machine. The method includes forming an insert body having a front surface and a back surface extending between opposite ends of the body, and a pair of laterally spaced sides extending between the upper and back surfaces. Generally flat front facets are formed on the front surface adjacent each end and generally flat end facets are formed on the end surfaces adjacent the front surface so that each end facet is disposed at an angle of at least 60 degrees to its adjacent front facet. A wear material coating is then adhered over the front and end facets.

According to another aspect of the inventive method, the step of forming generally flat end facets includes forming the end facets so that each end facet is generally perpendicular to its adjacent front facet.

According to another aspect of the inventive method, the step of forming generally flat front facets includes forming those facets to be generally coplanar.

According to another aspect of the inventive method, the step of forming generally flat end facets includes forming those facets to be generally parallel to one another.

According to another aspect of the inventive method, the step of forming generally flat front facets includes forming those facets to be generally parallel to an imaginary radius line passing from the rotational axis through the hammer when the insert is mounted on the hammer.

BRIEF DESCRIPTION OF THE SEVERAL VIEWS OF THE DRAWINGS

These and other features and advantages of the invention will become apparent to those skilled in the art in connection with the following detailed description and drawings, in which.

DETAILED DESCRIPTION OF THE PREFERRED EMBODIMENTS

Figure 1:
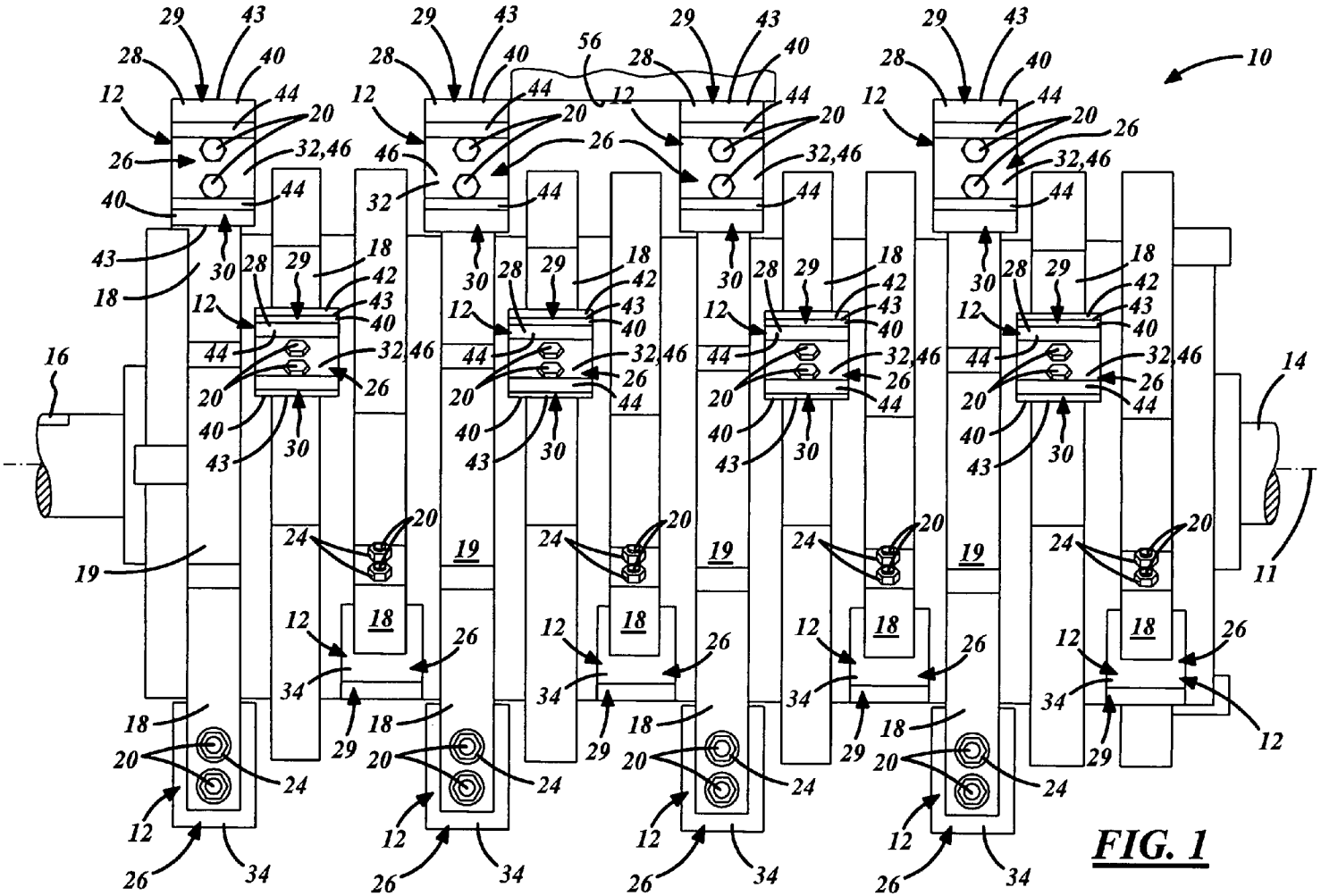
FIG. 1 is a schematic front view of a rotor assembly constructed according to one embodiment of the invention.
Figure 2:
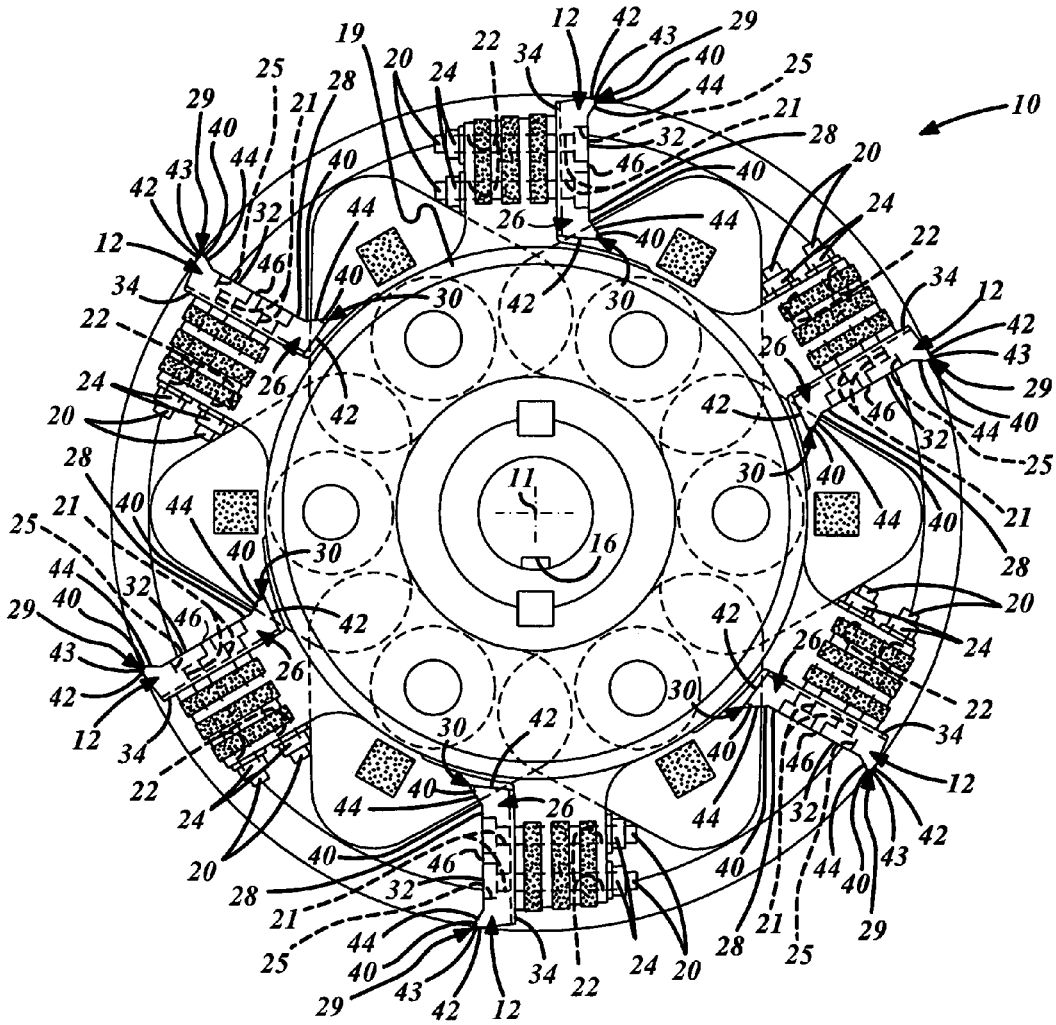
FIG. 2 is a partial schematic axial end view of the rotor assembly of FIG. 1.

FIGS. 1 and 2 illustrate a rotor assembly 10 constructed according to the invention for use in a comminuting machine for fragmenting wood products and the like. The rotor assembly 10 includes a shaft 14 arranged for driven rotation about an axis 11. The shaft includes a keyway 16 to facilitate operably coupling the assembly 10 to a drive motor such as a diesel engine (not shown). Typically, in addition to the keyway 16, the rotor assembly 10 may comprise sprockets and chains, or sheaves and belts, coupled to the drive motor. The rotor assembly 10 may be employed in comminuting machines for reducing wood product such as the horizontal grinder disclosed in U.S. Pat. No. 5,713,525 and U.S. patent application Ser. No. 10/774,548, which are incorporated into this document, in their entirety; and the tub grinders disclosed in U.S. Pat. No. 5,419,402; which is also incorporated into this document in its entirety.

Hammer inserts 12 are secured by any suitable fastening mechanism to hammers 18 carried by rotors 19. More specifically, each hammer insert 12 includes a mount 13 that removably attaches the insert 19 to a rotor-mounted hammer 18. The rotors 19 are carried by the shaft 14 in generally adjacent relation to one another for conjoint rotation with the shaft 14. The hammers 18 are fixed to the rotors 19 and extend radially outward from the shaft 14. In the present embodiment each of the hammer inserts 12 is releasably attached to one of the hammers 18 by a pair of bolts 20 as best shown in FIG. 2. The bolts 20 extend through bolt openings 21 in each insert 12 and corresponding bolt openings 22 in the corresponding hammer head 18, and is further secured by nuts 24. The openings 22 have hexagonal depressions or counterbores 25 as best shown in FIGS. 3-6. The depressions 25 are shaped to receive and engage the enlarged heads of the bolts 20, such that the bolt heads are seated in a generally flush position within the inserts 12 when the inserts have been secured to the hammer heads 18.

Figure 3:
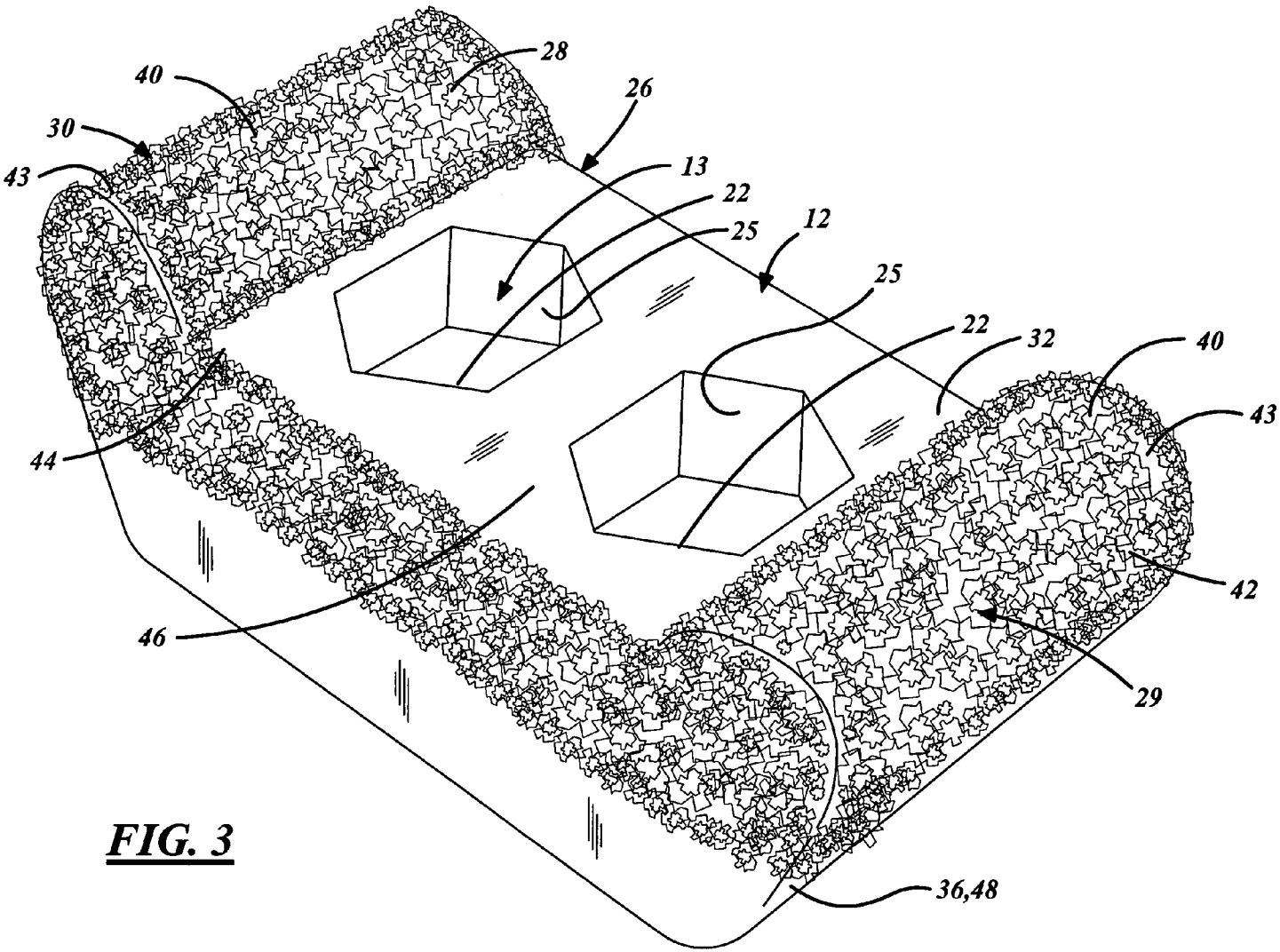
FIG. 3 is an enlarged perspective front face view of a hammer insert of the rotor assembly of FIG. 1.

As shown in FIG. 3, the hammer inserts 12 each have a body 26 fabricated from a steel alloy using a forging or casting process. In other embodiments the body 26 of each insert may be formed from any suitable material by any suitable means.

A wear material coating 28 is disposed over at least a portion of each insert 12 to include cutting edges 29, 30 at opposite ends of a wood-confronting front surface 32 of each insert 12. As best shown in FIGS. 1 and 2, one of the cutting edges 29 of each insert 12 is disposed in a radially-outward active cutting position while the other of the cutting edges 30 of each insert 12 is disposed in a radially-inward idle non-cutting position. Each hammer insert 12 is reversably attached to its corresponding hammer so that the two cutting edges 29, 30 can be interchangeably disposed in either the active cutting position or the idle non-cutting position.

Figure 4:
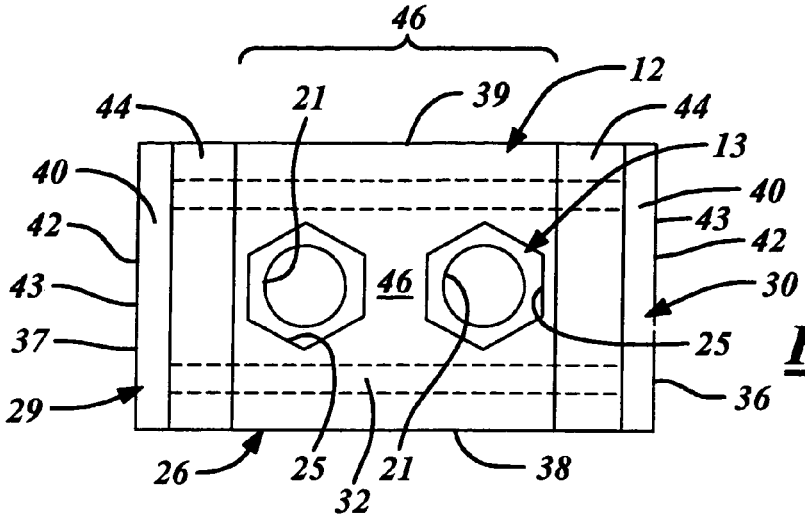
FIG. 4 is a schematic front face view of an insert body of the hammer insert of FIG. 3 with wear material of the hammer insert removed for clarity.
Figure 5:
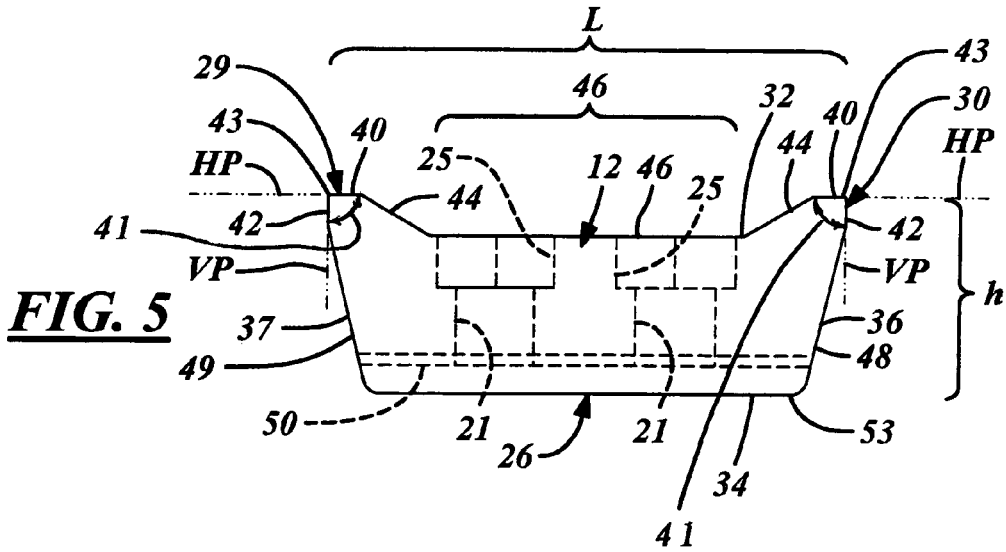
FIG. 5 is a schematic side view of the insert body of FIG. 4.
Figure 6:
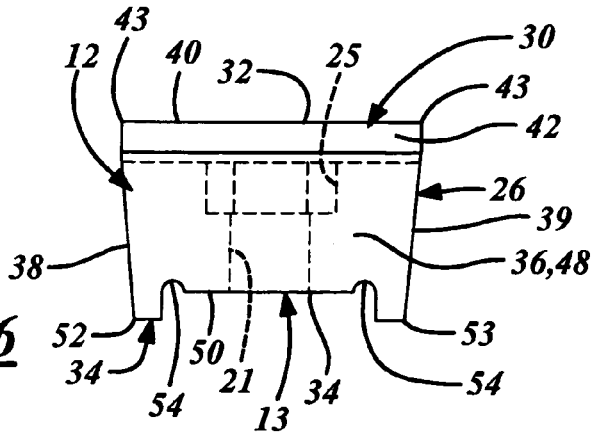
FIG. 6 is a schematic end view of the insert body of FIG. 4.

As best shown in FIGS. 5 and 6, each insert body 26 has a back surface 34 disposed opposite its front surface 32 and extending between opposite ends or end surfaces 36, 37 of each hammer insert 12. As best shown in FIGS. 4 and 6, each insert body 26 also includes a pair of laterally-spaced opposite side surfaces 38, 39 that extend between the front and back surfaces 32, 34 and the end surfaces 36, 37. The end surfaces 36, 37 of each insert 12 are inclined relative to one another as best shown in FIG. 5, and converge toward the back surface 34 at an inclination of about 6 degrees from a front plane to a back plane that extend generally perpendicular to the front and back surfaces 32, 34, respectively.

As best shown in FIGS. 3-6, the cutting edges 29, 30 of each insert body 26 are each defined by a flat front facet 40, a flat radially outer end facet 42 adjacent the front facet 40, and intervening corners 43 of the hammer insert 12 formed at the intersections of the front and end facets 40, 42. The front facets 40 are disposed in positions on each hammer insert 12 that will face the facets in the general direction of rotor rotation when the hammer insert 12 is carried by a rotor in a comminuting machine.

At least a portion of the wood-confronting front surface 32 of each hammer insert 12 that lies adjacent the opposite ends 36, 37 of each insert body 26 defines the generally flat laterally extending front facets 40, and at least a portion of each opposite end 36, 37 adjacent the front surface 32 of each insert body 26 incorporates a generally flat end facet 42. The front facets 40 are disposed at a relative included angle 41 of greater than 60 degrees to their respective adjacent end facets 42 and, in the present embodiment the front facets 40 are generally perpendicular to their respective adjacent end facets 42.

As shown in FIG. 5, in the present embodiment the front facets 40 of each hammer insert 12 define a plane HP and are generally coplanar and the end facets 42 of each hammer insert 12 are consequently generally parallel to one another. The plane HP of each hammer insert 12 is generally parallel to an imaginary radius line passing from the rotational axis 11 of the assembly 10 through the hammer 18 carrying the insert 12. As best shown in FIGS. 4 and 6, the front facets 40 have lengths extending between the side surfaces 38, 39 and widths that each extend at least about 2-10 percent of the length (L) of the front surface 32, with the length (L) of the front surface 32 being defined as the distance between the ends 36, 37. In the present embodiment the length (L) of the front wood-confronting surface 32 is about 4¾ inches, and thus, the width of each of the front facets 40 is about ¼ inch.

As is also shown in FIG. 5, the end facets 42 of each insert body 26 define front to back extending vertical planes VP and are generally parallel to one another. The end facets 42 have lengths extending between the laterally-spaced side surfaces 38, 39 and widths extending at least about 5-20 percent of the height (h) of the side surfaces 38, 39, with the height (h) of the side surfaces being defined as the distance between the front and back surfaces 32, 34. In the present embodiment the height (h) is about 2¾ inches, and thus, the end facets 42 each extend about ¼ inch. As such, the adjacent front and end facets 40, 42 are approximately equal to one another in width.

As best shown in FIG. 5, the front surface 32 of each insert body 26 has a pair of relief faces 44 that extend inward toward each other from the front facets 40 of each insert body 26 at an inclination that defines reflex angles ranging from about 210 to 220 degrees between the adjacent front facets 40 and relief faces 44. A generally flat mid section 46 extends between the relief faces 44 of each insert body 26 and is generally parallel to the back surface 34 of each body 26.

As shown in FIG. 5, the ends 36, 37 of each insert body 26 have inclined surfaces 48, 49 extending from the end facets 42 of each insert body 26 to the back surface 34 of the insert. The inclined surfaces 48, 49 converge toward one another at an angle ranging about 10-15 degrees from planes VP. The inclined surfaces 48, 49 extend to the back surface 34.

As shown in FIG. 6, the mount 13 of each insert body 26 is constructed for mating engagement with a hammer 18. To facilitate aligning and securing the inserts 12 to the hammers 18, the mount 13 includes, in the back surface 34 of each insert body 26, a recessed back surface 50 defining a pair of laterally-spaced depending lips or flanges 52, 53. The lips 52, 53 define an intervening space that is sized for close receipt of a hammer 18 between the lips 52, 53. As such, the lips 52, 53 cooperate to locate the insert 12 on the hammer head 18. Arcuate channels or reliefs 54 are formed between the recessed back surface 50 and the respective lips 52, 53. Each relief 54 extends along the length of the back surface 34 and is formed having a radius that blends with the adjacent lip 52, 53. The relief 54 acts to reduce stress loads and provides a uniform internal load distribution in the region of the insert 12 that mates with a hammer 18. The reliefs 54 extend the useful lives of the inserts 12 by resisting crack initiation and propagation. In other embodiments the back surface 34 of each hammer insert 12 could be constructed to include a generally flat back surface, or any other configuration suitable for mounting the inserts 12 on hammers 18.

As shown in FIG. 3, the wear material coating 28 is disposed primarily over the front and end facets 40, 42 and along a portion of the side surfaces 38, 39. The coating 28 is deposited on and adhered to these surfaces using a welding process. To facilitate adhesion of the wear material 28 to the insert body 26 the insert body 26 is first roughened—particularly in the areas where the wear material 28 is to be disposed. The insert body 26 may be roughed through any suitable means such as a shot blast The insert body 26 may be roughed through any suitable means such as a shot blast process. In the present embodiment the wear material 28 is a carbide weld material such as tungsten carbide. In other embodiments any other suitable material may be used.

In use, as the drive motor rotates the shaft 14 about its axis 11 and the shaft 14, in turn, rotates the inserts 12 about the shaft axis 11 to bring the active cutting edges 29 of the hammer inserts 12 into cooperation with a stationary anvil 56 to cut and/or fragment the wood product. As each cutting edge 29 impacts the wood product, the wood product is cut and fragmented by interaction of the cutting edge 29 and the anvil 56. While cutting wood the cutting edge 29 of each insert 12 is impacted by relatively large normal or head on forces and then tangential or shear forces. Because the angle 41 between the front and end facets 40, 42 is relatively large, there is more material between the facets 40, 42 to which the wear material 28 can adhere. This both improves adherence of the wear material 28 to the insert body 26 and strengthens the structure of the cutting edges 29, 30, resulting in an increased useful life for the cutting edges 29, 30 of the insert 12. The large angular distance between facets also limits weakening of the cutting edges 29, 30 caused by the metallic intrusion of the wear material welding operation into the facets.

Each hammer insert 12 may be fabricated by first forming an insert body 26 by forging or casting a steel alloy and then forming the front facets 40 on the front surface 32 adjacent each end surface 36, 37 and forming the end facets 42 on the end surfaces 36, 37 adjacent the front surface 32. The facets 40, 42 may be formed by any suitable means such as milling, grinding, or laser cutting. The facets 40, 42 are formed so that each end facet 42 is disposed at an angle 41 of at least 60 degrees to its adjacent front facet 40. In the present embodiment the facets 40, 42 are formed so that the front facets 40 are generally coplanar to each other and the end facets 42 are generally perpendicular to the front facets 40 and parallel to one another as described in detail, above. The front facets 40 are also formed to be generally parallel to an imaginary radius line passing from the rotational axis 11 through the hammer once the insert is subsequently mounted on a hammer 18. The insert body 26 is then roughened in the areas where the wear material 28 is to be disposed using a shot blast process or other suitable roughening means known in the art. The wear material coating is then adhered over the front and end facets 40, 42 by welding or other suitable means.

Once worn beyond acceptable standards, an insert 12 can be removed from the hammer 18 it is carried by, rotated 180 degrees, then re-attached to the hammer 18 so that the other edge 30 of the two cutting edges 29, 30 is moved from the idle position into the active cutting position. This reversibility of the inserts can double the useful life of each insert.

Obviously, it's possible to modify this invention from what the description teaches. Within the scope of the claims, one may practice the invention other than as described.

What is claimed is:

1. A rotor assembly for use in a comminuting machine for wood and the like, comprising;

a shaft arranged for driven rotation about an axis;

a plurality of rotors carried by the shaft in generally adjacent relation to one another for conjoint rotation with the shaft;

a plurality of hammer heads carried by the rotors and extending radially outwardly from the shaft; and a plurality of hammer inserts releasably attached to respective ones of the hammer heads, each insert including an insert body and a welded-on abrasive wear material coating over at least a first cutting edge portion of the insert body of each hammer insert insert body, the first cutting edge of each insert body being defined by a front facet generally facing the direction of assembly rotation, a radially outer end facet adjacent the front facet, and an intervening radially distal corner of the hammer insert formed at the intersection of the front and end facets, the front facet being disposed at a relative included angle of greater than 60 degrees to the end facet.

2. The rotor assembly of claim 1 in which the relative included angle between the front facet and the adjacent end facet of each insert cutting edge is greater than or generally equal to 90 degrees.

3. The rotor assembly of claim 1 in which the front facet of each insert cutting edge is generally perpendicular to the end facet of each insert cutting edge.

4. The rotor assembly of claim 1 in which the front and end facets of each insert cutting edge are flat.

5. The rotor assembly of claim 1 in which the front facet of each insert cutting edge is generally parallel to a back surface of the insert.

6. The rotor assembly of claim 1 in which each insert includes a second cutting edge disposed opposite the first cutting edge, each insert being reversibly attachable to a hammer to interchangeably dispose the two cutting edges in either a radially-outward active cutting position or a radially-inward idle non-cutting position.

7. The rotor assembly of claim 6 in which the second cutting edge of each insert body is defined by a front facet generally facing the direction of assembly rotation, an end facet adjacent the front facet and opposite the end facet of the first cutting edge, and an intervening corner formed at the intersection of the front facet and the end facet, the front facet of the second cutting edge being disposed at a relative included angle of greater than 60 degrees to the end facet of the second cutting edge.

8. The rotor assembly of claim 7 in which the front facets of the opposite cutting edges are generally coplanar.

* * * * *

UNITED STATES PATENT AND TRADEMARK OFFICE

CERTIFICATE OF CORRECTION

PATENT NO. : 7,438,097 B2
APPLICATION NO. : 11/363693
DATED : October 21, 2008
INVENTOR(S) : Devin R. Davis It is certified that error appears in the above-identified patent and that said Letters Patent is hereby corrected as shown below:

In Claim 1, column 7, line 19, "the insert body of each hammer insert insert body" should read --the insert body of each hammer insert--.

Signed and Sealed this

Sixth Day of April, 2010

David J. Kappos

David J. Kappos
*Director of the United States Patent and Trademark Office*